United States Patent [19]

Kaup

[11] Patent Number: 4,595,224

[45] Date of Patent: Jun. 17, 1986

[54] CARRYING DEVICE FOR CONTAINERS

[75] Inventor: Otmar Kaup, Aschaffenburg, Fed. Rep. of Germany

[73] Assignee: Kaup & Co. KG, Aschaffenburg, Fed. Rep. of Germany

[21] Appl. No.: 628,820

[22] Filed: Jul. 9, 1984

[30] Foreign Application Priority Data

May 24, 1984 [DE] Fed. Rep. of Germany ..... 3419363

[51] Int. Cl.[4] ..... B66C 1/66

[52] U.S. Cl. ..... 294/81.2

[58] Field of Search ..... 294/81.2, 81.1, 81.21, 294/81.3, 81.53, 81.6, 81.61, 67.2, 67.32; 414/607, 608, 629, 634, 635, 636, 637, 638, 639, 640, 641

[56] References Cited

U.S. PATENT DOCUMENTS 3,604,744 9/1971 Wright ..... 294/81.1

3,870,180 3/1975 Snelling, Jr. ..... 294/81.1

*Primary Examiner*—James B. Marbert

*Attorney, Agent, or Firm*—Mamorek, Guttman & Rubenstein

[57] ABSTRACT

Carrying device for a container with four supporting journals which, by means of a hydraulic actuating device 18, 21, can be locked or unlocked and respectively or with a hydraulic device 8, 9, 10, 11 for the change of the span width. A pumping device 23, 24, 25, 26 which can be actuated by means of a cable line is provided on the carrying device so that, also in the case in which the carrying device is attached to a crane without a pressure medium source, the hydraulic actuating device 18, 21 can be operated for locking and unlocking purposes, and respectively or the hydraulic device 8, 9, 10, 11 can be operated for the purpose of changing the span width.

15 Claims, 11 Drawing Figures

55
55
54
54
56
59
52
53
58
57
45
34
36
37
38
50
51
43
42
39
31
34
24
23
29
27
32
30
28
26
44
47
48
33
35
40
41
9
8
10
11
18
21

CARRYING DEVICE FOR CONTAINERS

The invention relates to a carrying device for containers or the like, with one supporting journal at each of the four corners, which supporting journal can be pivoted by means of a hydraulic actuation device for locking and unlocking purposes, and respectively or with a hydraulic device for the chang e of the span width, in other words of the distance of the supporting journals from one another, whereby the carrying device cna be attached to a carrying element of a lifting unit by means of traction members, whereby a cable, a chain or a band is to be understood when speaking of the traction member. It is known that such carrying devices are connected with a lifter (forklift) or a special device, whereby this lifter, respectively this device, on its part, displays a pressure medium source driven by the energy source of this lifter or special device, which pressure medium source is connected via hoses to the hydraulic device respectively to the hydraulic devices and acts upon the same through the intervention of valves which are arranged in the lifter, respectively in the special device. In the cases of the hitherto known carrying devices, the cited hydraulic devices can not be used when the carrying device is attached to a lifting unit such as a crane or the like, to the extent this lifting unit does not display a pressur medium source of its own which can be connected to the hydraulic device of the carrying device. When it had become necessary to attach the hitherto known carrying devices to such a lifting unit without its own pressure medium source, the licking and unlocking operations had to be carried out manually and a change of the span width could not be undertaken. Thus, the hitherto known carrying devices were only very little suited for use in lifting units without a pressure medium source of their own.

Furthermore, carrying devices are known which are provided for the attachment to cranes without a pressure medium source and, in the case of which, in addition to the carrying cables at which the carrying unit hangs, a shorter traction cable is provided which engages with a lever. This lever is connected with a mechanical transmission which, on its part, interacts with two shafts which lead to one cross-head each of the carrying device and are mechanically connected there with the rotatable supporting journals. Such mechanical devices are very expensive and require a great deal of maintenance and considerably increase the weight of the carrying device. In light of the restricted angle of traverse of the lever, tightening operations have to be carried out twice for each locking and unlocking procedure. This reduces the margin of reliability.

The invention is based on the task of also making a carrying device, designed according to the introductory part of claim 1, completely usable when this carrying device is attached to a lifting unit which does not display a pressure medium source of its own, that is to say that in the case of this carrying device, locking and unlocking operations can be carried out by means of a hydraulic actuating device and respectively or the span width can be changed, when no pressure supply from the lifting unit is possible.

This problem is solved in that for the pressure supply of the hydraulic device (actuating device for the locking and unlocking operations, respectively hydraulic device for the change of the span width), a pumping device, which can be actuated by means of a further, that is to say, additional traction member, which is likewise connected with the lifting unit, is provided at the carrying device. If the crane is a multi-cable crane, this additional traction member can be connected to the connection for a further cable, and the pumping device can be actuated through the intervention of the latter.

In accordance with a particularly advantageous form of execution of the invention, the device can also be used in the case of a crane displaying only one cable. In claim 3, an appropriate solution for this case is given, in other words, the length of the supporting traction members and the length of the additional traction member are of such relative dimensions with respect to one another, so that during the lifting operations, first of all the additional traction members tightens as long as the bearing traction members are not tightened and thereby actuates the pumping device, before the traction members which bear the entire carrying device pull tightly, whereby up to the moment at which these bearing traction members are pulled tightly, the additional traction member travels a path which is sufficient for a one-time actuation of the pumping device, that is to say, through the intervention of the additional traction member, the pumping device is actuated up to the moment the traction members provided for supporting purposes attain their tightened position. The pumping energy is thus supplied to the pumping device through the execution of a force in the additional traction member along an appropriate height of lift, whereby the counteracting force is created by the own weight of the carrier device. In its simplest form of execution which, however, is also very expedient, the pumping device can be a simple cylinder which is connected with the carrying device and the piston rod of which is connected with the traction member, whereby the piston supports itself against a spring which, during the loosening of the additional traction member, presses the piston back into its starting position. From a structural viewpoint, the simplest form results, when the traction member attacks the piston rod in the same direction. If the cylinder is arranged with the bottom section pointing upwardly, so that the traction member engages with the piston rod through the intervention of a yoke, the structural volume can be utilized to a better extent, since the pressure chamber on the piston-side has a greater volume than the one on the piston-rod - side. It would be a further advantage if the pressure chamber which is sealed-off by a sealing element along the piston rod, always displays only a low pressure. However, the pumping device can also be a rotating device, whereby the additional traction member is wound-up onto a cable-drum which automatically winds up through initial tension in the spring, with the cable-drum being connected with the shaft of the pumping device.

For the equalization of unequal lengths of the supporting traction members and of the additional traction member, length-equalization means are expediently provided, for example, in that a prestressed spring is built-in into the additional traction member, or in the case in which the lifting device is a cylinder, in that only a portion of the lifting motion is utilized, so that a residual portion of the lifting motion is at one's disposal in the case of unequal lengths, however, in each case the pumping device's displacement volume which is effective during the one-time tightening of the additional traction member should be greater or at least of the same order of magnitude than the effective stroke volume of the hydraulic actuating device for the locking and unlocking of the supporting journals, so that at each uplifting motion, the required stroke volume is actually at one's disposal for the locking, respectively, the unlocking processes. For the telescoping operations for the purpose of changing the span width, it is permissible that several lifting motions are required of the additional traction member.

A particularly expedient further development of the invention relates to the hydraulic circuits and here in particular to a circuit, through the intervention of which it is achieved that at each stroke of the pumping device, that is to say at each tightening of the additional traction member from the slack position into the final position, when switching to the actuating device for the locking and unlocking operations, each time a full stroke movement is executed in the hydraulic devices for the locking and unlocking operations, namely always alternating locking and unlocking operations, so that after each piling-up operation, locking operations are carried out automatically and at each second tightening, unlocking operations are carried out, prior to the time the supporting traction members lift-off the carrying device. Advantageous refinements in regard to such a hydraulic circuit are discussed in claim 5 and the following.

Through other expedient further developments, it is prevented that, when the container-carrying-device is connected to a pressure medium line of a forklift, so much pressure medium flows from the latter into the container-carrying-device, so that the pressure medium receptacle, which is arranged at the container-carrying-device, overflows, that is to say pressure media emerge from the opening of the air equilibrator.

The invention and details of the same are explained in the following while making reference to the exemplified embodiments illustrated in the drawing.

FIG. 9 shows the actuating lever in locking position.

Figure 1:
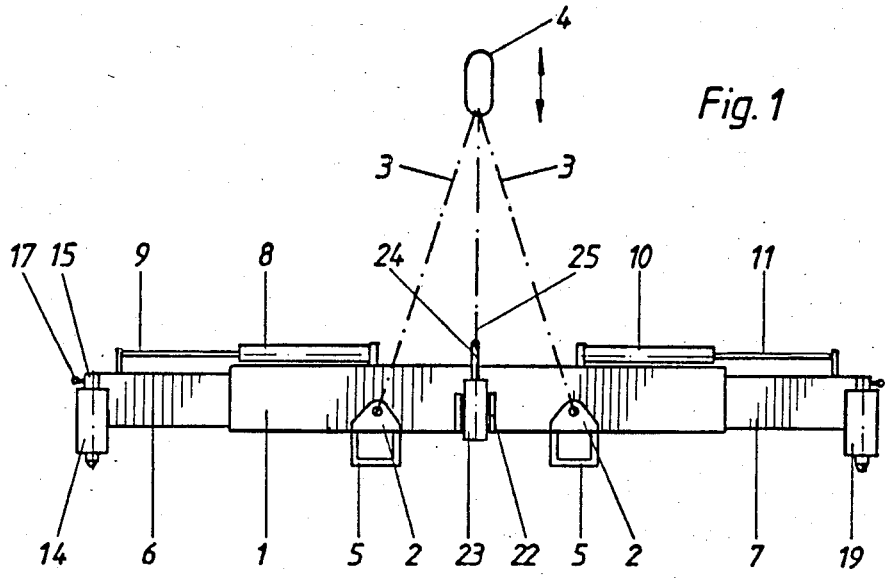
FIG. 1 shows a side view of a carrying device.

At the bottom side of the basic element 1, two up-take pockets 5 are provided, into which one fork-prong each of a forklift can be inserted when the carrying device is to be taken up by a forklift. Two mounting eyelets 2 are connected with the upper side of each up-take pocket 5. At each of these mounting eyelets 2, a supporting cable 3 is attached. The four supporting cables 3 are jointly hung into a supporting ring 4 which, on its part, can be attached to a hook of a crane, with the hook as well as the crane not being illustrated in the drawing. In the basic element 1, two telescopic parts 6 and 7 are mounted in an axially displaceable manner. The axial displacement of the telescopic part 6 is effected by a cylinder-piston aggregate with cylinder 8 and the piston rod 9, whereas the displacement of the telescopic part 7 is effected by a cylinder-piston aggregate, with cylinder 10 and piston rod 11, whereby the piston rod 11 is affixed at the telescopic part 7 and the cylinder 10 is affixed at the basic element 1. In analogous manner, cylinder 8 is affixed at the basic element 1 and the piston rod 9 at the telescopic part 6.

Figure 2:
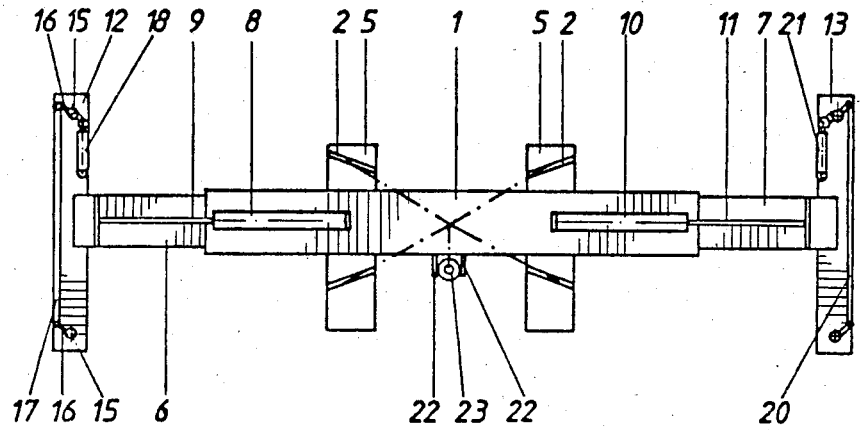
FIG. 2 shows a top view of the same carrying device.

At the end of the telescoping part 6 a cross-head 12 is attached and at the end of the telescoping part 7 a cross-head 13 is attached. At the two ends of the cross-head 12 one supporting journal device (twistlock device) 14 each is arranged, of which each rotary journal 15 involved at a given time, is connected with a lever 16, whereby the levers 16 are connected with one another through the intervention of a driving rod 17. The upper lever 16 in FIG. 2 is designed as a two-armed lever, with the second arm of which the piston rod of a piston, which can be displaced with a cylinder 18, engages.

At the cross-head 13, two such types of supporting journal devices are likewise provided, the assigned levers of which are connected with one another through the intervention of a driving rod 20, and whereby the actuation is effected by a cylinder 21.

On the side of the basic element 1, namely between two mounting plates 22, a pump-cylinder 23 is arranged, within which a piston can be moved, the piston rod 24 of which is connected with an additional traction member 25.

Figure 3:
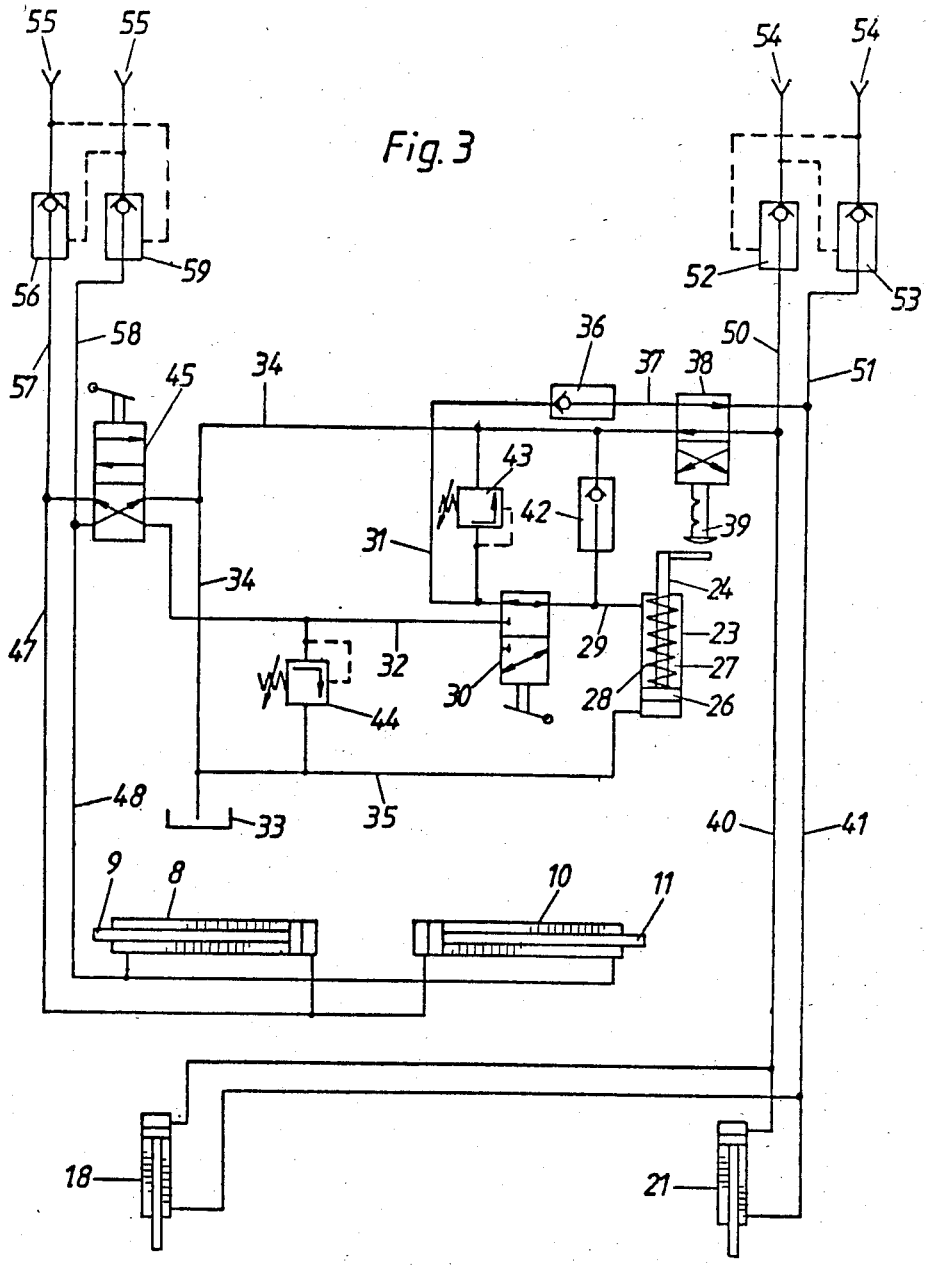
FIG. 3 shows a circuit diagram for the interconnection of the pumping device and the two hydraulic devices.

FIG. 3 illustrates the hydraulic circuit through which the pump-cylinder 23 is connected with the cylinders 8 and 10 for the telescoping operations, and with the cylinders 18 and 21 for the actuation of the unlocking and locking operations.

Within the pump cylinder 23, a piston 26 can be moved, whereby the effective pressure chamber 27 is formed on the piston rod side and a compression spring 28 is arranged within this pressure chamber.

This pressure chamber 27 is connected to a conveying line 29, which leads to the input of a three-junction/two-position/passage-valve 30 which can be arbitrarily operated. At the one outlet of this three-junction/two-position/passage valve 30, a line 31 is connected, which is assigned to the actuating device for the locking and unlocking operations, whereas at the other outlet-connection of this passage-valve 30, a line 32 is connected, which is assigned to the telescoping device 8, 9-10, 11. To a pressure-less receptacle 33, line 34 is connected, on the one hand, and on the other hand, line 35 is connected, whereby the pressure medium, which in a given case leaks along the piston 26, is carried off via the line 35.

The piston surface of piston 26 is imparted such dimensions, so that at the highest possible pressure in the course of the operation, the force in the piston rod 24 is in any case of a lower order of magnitude than that of the total weight of the carrying device without containers.

Line 31 leads to a return-flow stop-valve 36 from which a line 37 leads to the four-junction/two-position/passage valve 38, the actuating device of which, through the intervention of an alternating quick-break or jump switching device 39, is in such a type of operating connection with the poston rod 24, so that each time when the piston rod 24 has attained its completed final operating position, valve 38 is switched over into another of the two possible switching positions. To the two outputs of valve 38, the two lines 40 and 41 are connected, of which line 40 leads to the pressure chambers of cylinders 18 and 21 on the piston-side, and line 41 leads to the pressure chambers of cylinders 18 and 21 on the piston-rod - side.

Between lines 34 and 29 a return-flow stop valve 42 is arranged which opens in the direction toward line 29. A corresponding pressure-limiting valve 44 is put into the circuit between line 32 and line 35.

The line 32 leads to an inlet of a four-junction/two-position/passage valve 45 which can be arbitrarily operated, through the position of which, the direction is determined as to whether the piston rods 9 and 11 ascend from the cylinder 23 or descend into the same in the course of the conveying operations. At one outlet of the passage-valve 45, a line 46 is connected which leads to the two pressure chambers of cylinders 8 and 10 on the piston-side, and at the other outlet a line 47 is connected which leads to the pressure chambers of the cylinders 8 and 10 on the piston-rod - side.

The mode of operation is the following: If, in the position of the passage-valve 30 which is illustrated in the drawing, the piston rod 24 is pulled-out of the cylinder 23, pressure medium from the pressure chamber 27 is conveyed through lines 29, 31, 37 and 41 into the pressure chambers of the cylinders 18 and 21 on the piston-rod - side and by that means, the supporting journals (twistlocks) are locked. When attaining the final position of the piston-rod 24, the passage-valve 38 is then switched over by means of the quick-break or jump switching device 39.

If the carrying device is now put down and the additional traction member thereby becomes slack, the piston 26 is pressed into the cylinder 23 under the action of spring 28 and on the next tightening of the additional traction member 25, piston 26 again conveys from the pressure chamber 27 into the pressure chambers of the cylinders 18 and 21 on the piston-side, through the intervention of lines 29, 31, 37 and now 40, so that the supporting-journal devices become unlocked.

In order to achieve with certainty that, at each tightening and pass-through of the additional traction member 25, the pistons are completely moved into the cylinders 18 and 21 into the final operating position in each given case, the displacement volume in the pressure chamber 27 is greater than the sum of the displacement volumes of the pressure chambers of cylinders 18 and 21 on the piston-side. If the pistons had reached their end position in the latter and if the piston 26 nevertheless continues to convey, then the excess pressure medium is conducted away via the pressure-limiting valve 43 into the line 43 and via the latter is conveyed into the receptacle 33. If the passage valve 30 is in the second position which is not illustrated in the drawing, the pressure medium conveyed from the cylinder 23, is conveyed to the cylinders 8 and 10.

In the case the pistons are moved into the end-position within the cylinders 18 and 21 and the pump-cylinder 23 no longer continues conveying, the return-flow-stop-valve 36 prevents that the pistons retreat, thus it serves for the purpose of locking the piston within the two cylinders 18 and 21. When the traction member 25 becomes slack, the piston 26 in cylinder 23 is again pressed back under the action of spring 28 and aspirates from the receptacle 33 via line 29, via the return-flow-stop valve 42 and via line 34. The return-flow-stop-valve 42 is closed when the conveying operation is carried out from pump-cylinder 23.

So that the carrying device designed according to the invention can also be optimally used in the case it is taken-up by a lifter which is equipped with a pressure medium source and control members for the pressure medium flow, one additional line 50 and 51 each is connected to each of the two lines 40 and 41. Each of these two lines 50 and 51 leads to a separable connecting piece 54 which serves for the connection with a pressure line of a lifter no longer illustrated in the drawing. Into line 50, an unlockable return-flow-stop-valve 52 is inserted, the control connection of which is connected to line 51 between the return-flow-sto-valve 53 and the connecting piece 54. In similar manner, an unlockable return-flow-stop-valve 53 is inserted in line 51, the control chamber of which is connected with line 50 between the return-flow-stop-valve 52 and the connecting piece 54. If the connecting pieces 54 are connected to the pressure lines of the lifter and if the line 50 is loaded with pressure, the return-flow-stop-valve 52 opens so that it can be streamed through. The return-flow-stop-valve 53 is regulated at the same time in such a manner so that the pressure medium can flow-off through line 51 which then acts as return-flow line. The effect is analogous when line 51 is loaded with pressure, so that the return-flow-stop-valve 53 is streamed through and the return-flow-stop-valve 52 is regulated. In the case of such a form of execution it is expedient if, in the place of the passage-valve 38, a four-junction/three-position/-passage-valve is provided which, when connected to a lifter, arbitrarily can be brought into the third switching position, in which all connections are closed or if an additional stop-valve is arranged in lines 37 and 34.

To line 47, line 57 in which an unlockable return-flow-stop-valve 56 is arranged, is connected in analogous manner and leads to a connecting piece 55, and to line 48, a line 58 in which an unlockable return-flow-stop-valve 59 is arranged, is connected and leads to a connecting piece 55. The control chamber of the return-flow-stop-valve 56 is connected to the line 58 and the control chamber of the return-flow-stop-valve 59 is connected to the line 57. The effect is analogous to that of the return-flow-stop-valves 52 and 53. It is expedient in this case if, in place of the passage-valve 45 a four-junction/three-position/passage-valve is provided which, in one switching position, locks all connections.

Figure 5:
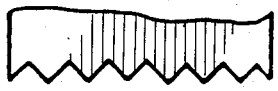
FIGS. 5, 6 and 7 shows developed projections of the outline of components of this valve.
Figure 6:
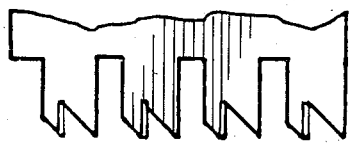
Figure 7:
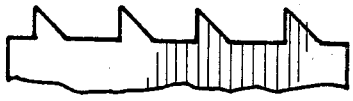
Figure 4:
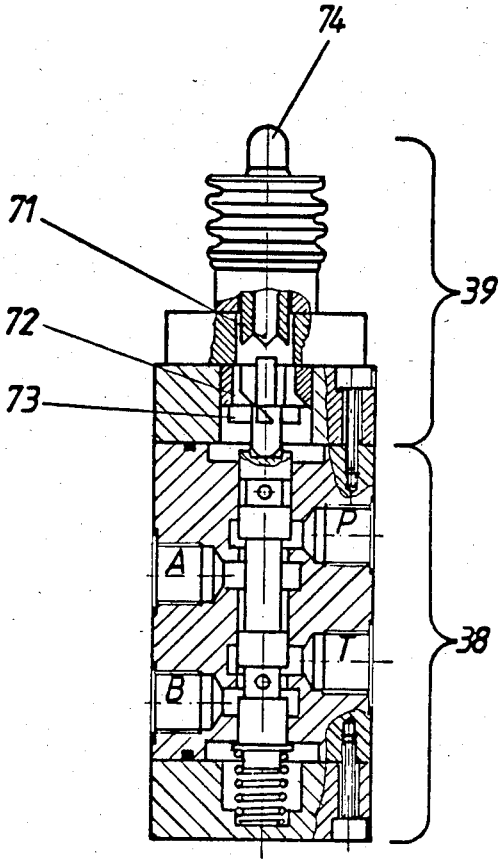
FIG. 4 shows a cross-section through a passage-valve with alternating change-over device.

The passage-valve 38 and the alternating-switching-device 39 connected with the same, are illustrated in FIG. 4 in form of a cross-section. The alternating-switching-device 39 displays ring-shaped component parts 71, 72 and 73. A developed projection of the circumference of the component part 71 is shown in FIG. 5, a developed projection of the circumference of component part 72 is shown in FIG. 6 and a developed projection of the circumference of the component part 73 is shown in FIG. 7. These component parts are provided in such a manner with projections serving as stopping elements, so that each time when the piston rod 24 is moved toward the actuating head 74, the stopping elements rotate relatively with respect to one stopping element and valve 38 is moved one time into the one switching position and the next time into the other switching position.

Figure 8:
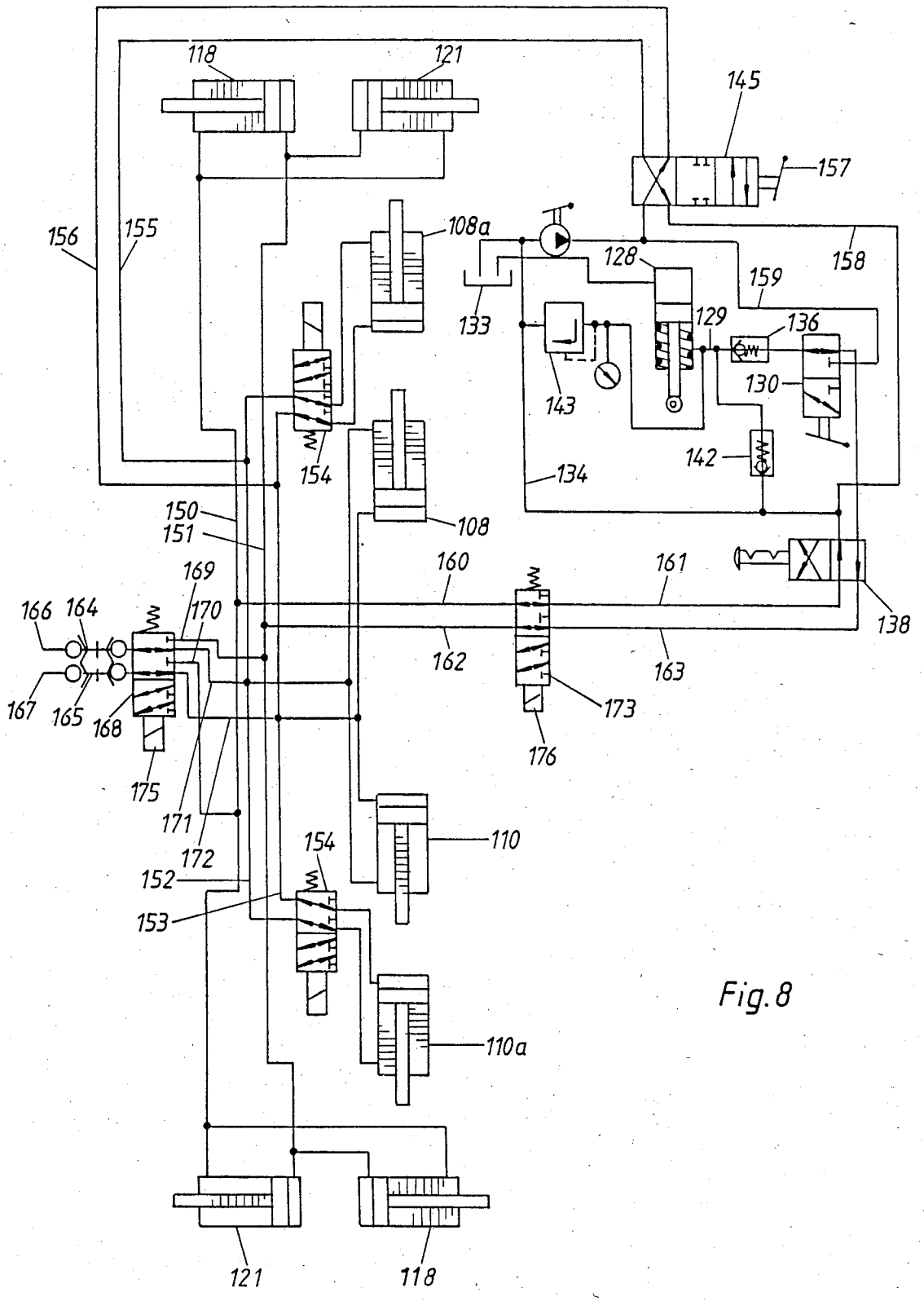
FIG. 8 shows a circuit with connections for the lines leading to the pressure medium pump of a stacker and to the receptacle of the stacker, and also shows additional valves in order to prevent an overfilling of the receptacle of the carrying device.
Figure 9:
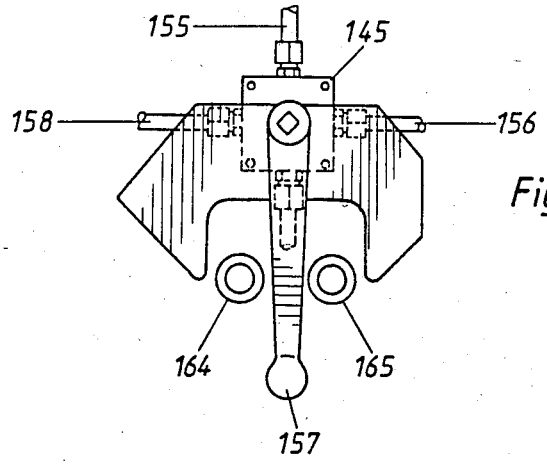
FIG. 9 shows a valve with actuating lever and a blocking metal piece connected with the latter, and also shows the connecting elements for the lines leading to the stacker.
Figure 9A:
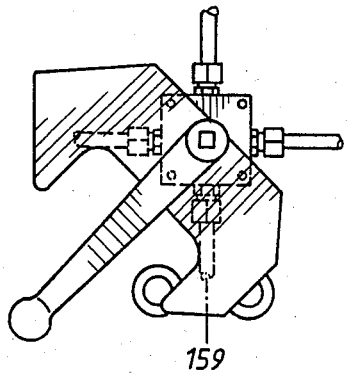
FIGS. 9*a* and 9*b* show the actuating lever in the to other switching positions of the valve.
Figure 9B:
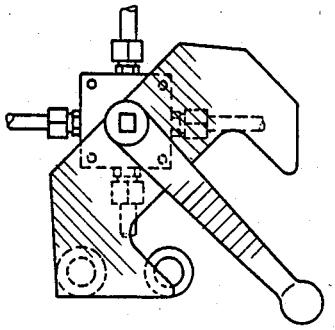

In the circuit diagram shown in FIG. 8, the pumping-device-cylinder 128 corresponds to the cylinder 28 as shown in FIG. 3, the line 129 corresponds to line 29 as shown in FIG. 3, the valve 130 corresponds to valve 30 as shown in FIG. 3, the valve 138 corresponds to valve 38 as shown in FIG. 3, the valve 142 corresponds to valve 42 as shown in FIG. 3, the valve 143 corresponds to valve 43 as shown in FIG. 3, and the line 134 corresponds to line 34 as shown in FIG. 3. The valve 136, in essence, corresponds to valve 36 as shown in FIG. 3, however, it is switched into the system at another site. The cylinders 108 and 108*a* serve for telescoping operations and cylinders 118 and 121 serve for locking and unlocking operations. Lines 150 and 151 lead to these cylinders 118 and 121 which serve for the locking and unlocking operations. For the pressure supply of the cylinders 108 and 108*a* and 110 and 110*a*, serving for telescoping purposes, the two lines 152 and 153 serve, to which one change-over valve 154 each is connected, which can be actuated arbitrarily and through the intervention of which it is determined as to whether cylinders 108 and 110 are connected to lines 152 and 153 or whether in addition also cylinders 108*a* and 110*a* are connected. Through this measure, different spreading or expanding positions can be arbitrarily created.

The lines 152 and 153, which act upon the cylinders 108, 108*a*, 110 and 110*a* serving for the spreading or expanding operations, are connected to lines 155 and 156 which are connected with the two outlets of a four-junction/three-position/passage-valve 145. This four-junction/three-position/passage valve 145 can be arbitrarily actuated by means of the actuating lever 157. To the two inlet-connections of this four-junction/three-position/passage-valve 145, the two lines 158 and 159 are connected, of which line 158 is connected to the return-flow line 134 leading to the receptacle 133, and line 159 is connected via valve 130 to cylinder 128 of the pumping device.

So that the cylinders 118 and 121, serving for the locking and unlocking operations, can be acted upon with pressure media emanating from the pumping device 128, the line 150 is connected with an outlet-connection of the valve 138 through the intervention of lines 160, 161, and furthermore, line 151 is connected with the second outlet-connection of valve 138 through the intervention of lines 162, 163. Thus, depending on the setting of valve 138, the line 151 can be loaded with the pressure medium from the pumping-device 128 through the intervention of lines 162, 163, or line 150 can be loaded with the pressure medium from the pumping device 128 through the intervention of lines 160, 161.

The connecting members 164 and 165 serve for the connection of lines 166 and 167, of which line 166 leads to a hydraulic pump which is no longer illustrated in the drawing and is associated with a stacker which is likewise not illustrated in the drawing, and line 167 leads to a pressure-medium-receptacle of this stacker. The connecting member 164 is connected to an inlet-connection of a 6-junction/two-position/passage-valve 168 and the connecting member 165 is connected to the second inlet-connection of this passage-valve 168.

Onto a pair of outlet connections of this passage-valve 168, the two lines 169 and 170 are connected, of which line 170 is connected to the line 150 and the line 169 is connected to the line 151, so that these two lines 169 and 170 serve for the pressure medium supply of cylinders 118 and 121 serving for the locking and unlocking operations.

Lines 171 and 172 are connected to the two other connections of the second outlet-connecting pair of valve 168, of which line 171 is connected to line 152 and line 172 is connected to line 153, so that the two lines 171 and 172 serve for the pressure medium supply of the cylinders 108, 108*a*, 110, 110*a* serving for the spreading or expanding operations.

If, to give an example, the pressure medium is conveyed into the line 169 from the forklift through the intervention of line 166, the danger exists that this pressure medium, via lines 162 and 163, arrives in line 134 and consequently into the receptacle 133 and causes the same to overflow, while in the case of another switching position of the passage-valve 168 the danger exists that the pressure medium arrives in line 152 from line 166 and from line 152, via line 155, again arrives in line 134.

In order to prevent this, the stop-valve 173 is switched-in between lines 160 and 161 on the one hand, and between lines 162 and 163 on the other hand, whereby the actuation of the stop-valve 173 is associated in such a manner with the actuation of the passage-valve 168 so that, when the passage-valve 168 is switched to lines 169 and 170, the stop-valve 173 is closed, that is to say, when pressure media from the stacker can flow from line 166 into one of the two lines 150 or 151, both lines 160 and 162 are closed through the intervention of the stop-valve 173, so that it is impossible that the pressure medium can flow into the receptacle 133.

The actuating member 157 of the passage-valve 145 is connected in such a manner with the stop-plate 174, so that the connecting members 164 and 165 are accessible for the connection of lines 166 and 167 only in the state in which the passage-valve 145 is in locking position, that is to say when the pressure medium from line 166 can flow, via the connecting member 164, into one of the two lines 150 and 151 and from the latter into lines 155 and 156, the passage-valve 145 is automatically switched into the locking position, so that no pressure medium can arrive in the receptacle 133 via lines 171, 152, 155 or in the reverse case, can arrive in line 134, via lines 172, 153, 156.

The lines which are connected to the connecting members 164 and 165, also prevent that the actuating member 157 is swung out from this locking position.

In known manner, the connecting members, 164, 165 are equipped in such a manner with return-flow-stop-valves so that, in the case a line 166 or 167 is not connected and the return-flow-stop-valve 167 is mechanically opened thereby, the lines are locked so that, when no lines are connected to the connecting members 164, 165, no pressure medium can emerge from the connecting members 164 and 165. However, it is also possible in an additional precautionary manner to provide the passage-valve 168 with an additional locking position, into which the passage-valve 168 moves when no lines 166 and 167 are connected to the two connecting members 164 and 165.

The passage-valve 168 is electrically controlled in such a manner by means of the magnet 175 so that, in the state in which voltage is applied to this magnet, the passage-valve 168 switches to lines 169, 170. The stop-valve 173 is actuated in such a manner by means of a magnet 176 so that, when voltage is applied to this magnet 176, the stop-valve 173 moves into the locking position. Through the intervention of lines which are no longer shown in FIG. 8, the magnets 175 and 176 are connected in series or in parallel to the same switching element, so that voltage can always be simultaneously applied automatically to both magnets 175 and 176.

We claim:

1. A carrying device for lifting a container by means of a lifting unit, comprising a frame, said frame having four corners and defining a width and a length, the width of said frame being adjustable, lifting means located at each of the corners of said frame, said lifting means adapted to engage and disengage said container, hydraulic means associated with said frame and said lifting means for adjusting the width of said frame to conform to the width of said container and for actuating said lifting means, and engagement means mounted on said frame connecting said carrying device to said lifing unit, said engagement means including a traction member associated with said hydraulic means, said hydraulic means being actuated by said traction member in response to said carrying device being lifted by said lifting unit.

2. Carrying device according to claim 1, characterized in that the pumping device is a cylinder-piston-aggregate (23, 24), the cylinder (23) of which is attached to the carrying device, and the piston (26) of which can be displaced in opposition to the force of a spring (28) and with the piston-rod (24) of which the additional traction member is connected.

3. Carrying device according to claim 1, characterized in that the length of the additional carrying device is imparted such dimensions so that in the case when the traction members (3) which are provided for carrying purposes are still slack, the additional traction member (25) tightens and in the case of tightened supporting traction members (3), with the position of the piston (26) of the pumping device (23, 24) being displaced in opposition to the force of spring (28), the addition traction member (25) is tightened.

4. Carrying device according to claim 1, characterized in that at a one-time tightening of the additional traction member (25), effective displacement volumina of the pumping device (23, 24) are at least of the same order of magnitude as the effective than the effective stroke volume of the actuating device (18, 21) for the locking and unlocking of the supporting journals.

5. Carrying device according to claim 1, which is provided with a device for the actuating of the unlocking and locking of the supporting journals, as well as also with a device for the change of the span width, characterized in that to the conveying line (29) of the pumping device (23) a three-junction/two-position/passage-valve (30) is attached, to one outlet of which the actuating device (18, 21) for the locking and unlocking of the supporting journals is connected and to the other outlet of which, the device (8, 9, 10, 11) for the change of the span width is connected.

6. Carrying device according to claim 1 with an actuating device with double acting cylinders for locking and unlocking of the supporting journals, characterized in that to the conveying line (29–31) of the pumping device (23, 24), a four-junction/two-position/passage-valve (38) is connected, at the two outlets of which, the two lines (40, 41) are connected which lead to one side each of the cylinders (18, 21) of the actuating device and to the second inlet of which a line (34) is attached which leads to a pressureless storage receptacle and the actuating member of which is connected in such a manner with the pumping device (23, 24, 26) via an alternating quick-break or jump switching device (39), so that at each time when the piston rod (24) has attained the final position on the displacement side of the piston (26) of the pumping device (23, 24), the passage-valve (38) is always switched over to the other of its two possible switching positions.

7. Carrying device according to claim 6, characterized in that to the conveying line (29) of the pumping device (23, 24, 26), in front of the passage-valve (30), a connecting line is connected which, on the other hand, is connected to the discharge line (34), in which connecting line a return-flow-stop-valve (42) is arranged which opens in the direction toward the conveying line (29).

8. Carrying device according to claim 1, characterized in that line (29 or 31 or 37 or 32) emanating from the pumping device (23, 24, 26), a connecting line (50, 51, 57, 58) is attached, which leads to a connecting piece (54 or 55) provided for the connection to a pressure line and in which a return-flow-stop-valve is arranged, which opens toward the line (29, 31, 32, 37) that is connected to the pumping device (23, 24, 26).

9. Carrying device according to claim 8, characterized in that the connecting line (50, respectively 51, respectively 57, respectively 58) is arranged between the passage-valve (30), which can be arbitrarily switched over to the actuating devices (18, 21 or 8, 9, 10, 11), and the actuating devices (18, 21 or 8, 9, 10, 11) in question at the given time.

10. Carrying device according to claim 9, characterized in that to each of the lines (40, 41, respectively 47, 48) which lead in each given case to one cylinder side, a connecting line (50, or 51, or 57, or 56) is connected, and in that the return-flow-stop-valve which is arranged in each connecting line, is an unlockable return-flow-stop-valve (52, or 53, or 56, or 59) and in that the control chamber of each of these return-flow-stop-valves (52, 53, 56, 59) is always connected with the other line of the same line pairs (40, 41, respectively 47, 48).

11. Carrying device according to claim 1, whereby to the conveying line (129) of the pumping device (128), a connecting line is attached which leads to a connecting member (164 or 165), which is provided for the connection of the conveying line of the hydraulic pump of a forklift, and to the return-flow line (134), an additional connecting line is attached which leads to a connecting member (165 or 164), that is provided for the connection of a return-flow line leading to the receptacle of the stacker, characterized in that an additional stop-valve is provided, through which the lines (155 and 156) can be locked which lead to the cylinders (108, 108*a*, 110, 110*a*) serving for the telescoping operations, and in that the actuating member (157) for this additional stop-valve is connected in such a manner with a locking element for the connecting members (164 and 165), so that the pressure-medium-lines (166 and 167) which emanate from the stacker, can only be connected with the connecting members (164 and 165) when the additional stop-valve finds itself in the locking position, whereby the lines (171 and 172) which lead to the connecting members (164 and 165), are connected between the additional stop-valve and the cylinders (108, 108*a*, 110, 110*a*) which serve for the telescoping operations.

12. Carrying device according to claim 1, characterized in that the additional stop-valve is designed as an additional locking-switch-position at the change-over valve (145), through which one can selectively switch to telescoping stages bringing about expansion or size reduction.

13. Carrying device according to claim 1, with cylinders for telescoping purposes, as well as with cylinders for locking purposes, and with connecting members (164, 165), by means of which a line (166) which leads to a pressure medium source of a forklift, and a line (167) which leads to a receptacle of the forklift, can be connected to the lines leading to the cylinders serving for the locking and unlocking operations, and to the lines leading to the cylinders serving for the telescoping operations, characterized in that in the lines lying in each given case between a connecting member (164, respectively 165) and a line (150, 151, 152, 153) leading to a cylinder (108, 108*a*, 110, 110*a*, 118, or 112), a change-over valve (168) which can be arbitrarily actuated is arranged, through the intervention of which the connecting members (164, 165) can be selectively connected either with the cylinders (108, 108*a*, 110, 110*a*) which serve for the telescoping operations, or with the cylinders (118, and 121) which serve for the locking and unlocking operations, and in that an additional stop-valve (173) is arranged in the lines (160, 161, 163, 162) which lead from the pumping device (128) to the cylinders (118, 121) serving for the locking and unlocking operations, and in that the actuating devices of the two valves (change-over valve 168 and stop-valve 173) are in such a type of operating connection with one another, so that the additional stop-valve (173) is closed when the change-over valve (168) is switched to the lines (150, 151) leading to the cylinders (128, 121) serving for the locking and unlocking operations.

14. Carrying device according to claim 13, characterized in that the change-over valve (168) and the stop-valve (173) are valves which can be electrically actuated and in that the change-over valve (168) is connected in such a manner, so that in the case when a voltage is applied to magnet (175), the change-over valve is switched to the lines (150, 151) leading to the cylinders (118, 121) serving for the locking and unlocking operations, and in that the additional stop-valve (173) is placed into the locking position when a voltage is applied to the magnet (176), and in that furthermore the magnet (175) of the change-over valve (168) and the magnet (176) of the stop-valve (173) can be simultaneously connected in series or in parallel to the same voltage source.

15. The carrying device of claim 1 wherein said lifting means comprise twist locks.

* * * * *